US010816159B2

(12) United States Patent
Enomoto et al.

(10) Patent No.: US 10,816,159 B2
(45) Date of Patent: Oct. 27, 2020

(54) VEHICLE LAMP

(71) Applicant: Koito Manufacturing Co., Ltd., Tokyo (JP)

(72) Inventors: Tatsunari Enomoto, Shizuoka (JP); Tomoyuki Watanabe, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 16/460,077

(22) Filed: Jul. 2, 2019

(65) Prior Publication Data

US 2020/0018457 A1 Jan. 16, 2020

(30) Foreign Application Priority Data

Jul. 10, 2018 (JP) ..... 2018-130921

(51) Int. Cl.

| | |
|---|---|
| ***F21V 9/00*** | (2018.01) |
| ***F21S 43/241*** | (2018.01) |
| ***F21S 43/40*** | (2018.01) |
| ***F21S 43/239*** | (2018.01) |

(52) U.S. Cl.

CPC ..... *F21S 43/241* (2018.01); *F21S 43/239* (2018.01); *F21S 43/40* (2018.01)

(58) Field of Classification Search

CPC ... F21S 43/14; F21S 43/239–251; F21S 43/40
USPC ..... 362/511, 609, 621–626
See application file for complete search history.

(56) References Cited

U.S. PATENT DOCUMENTS 10,012,359 B2 * 7/2018 Doha ..... F21S 41/322

FOREIGN PATENT DOCUMENTS

JP 2016-091825 A 5/2016

* cited by examiner

*Primary Examiner* — Jason M Han
(74) *Attorney, Agent, or Firm* — Abelman, Frayne & Schwab

(57) ABSTRACT

A vehicle lamp includes a light emitting element; and a plate-shaped light guide arranged such that a longitudinal direction thereof crosses an optical axis of the light emitting element. The plate-shaped light guide includes an introducing portion, a reflecting portion, and an emitting portion. The reflecting portion is arranged in front of the optical axis, and includes a front side reflective surface that reflects the light from the introducing portion toward the emitting portion. The front side reflective surface includes a plurality of diffusing steps that diffuses the light from the introducing portion in an extending direction of the plate-shaped light guide.

9 Claims, 8 Drawing Sheets

VEHICLE LAMP

CROSS-REFERENCE TO RELATED APPLICATIONS

This application is based on and claims priority from Japanese Patent Application No. 2018-130921, filed on Jul. 10, 2018, with the Japan Patent Office, the disclosure of which is incorporated herein in its entirety by reference.

TECHNICAL FIELD

The present disclosure relates to a vehicle lamp, particularly, a vehicle lamp using a light-emitting element and a plate-shaped light guide.

BACKGROUND

In the related art, a vehicle lamp has been proposed in which a light emitting element such as an LED and a plate-shaped light guide that controls light from the light emitting element are combined (see, e.g., Japanese Patent Lain-Open Publication No. 2016-091825). In the vehicle lamp, the light from the light emitting element is introduced into the inside of the plate-shaped light guide from an introducing portion provided on a surface of the plate-shaped light guide. The entire light is reflected by a reflecting portion that is provided on a back surface of the plate-shaped light guide, travels in the plate-shaped light guide, and is emitted from an emitting portion that is provided on an end surface of the plate-shaped light guide.

SUMMARY

In the above-described vehicle lamp, there is a problem that it is difficult to make the brightness of the light emitted from the emitting portion uniform.

The present disclosure has been made in consideration of the circumstances, and the present disclosure is to provide a vehicle lamp in which the brightness uniformity of the emitted light is enhanced.

In order to solve the above problem, the vehicle lamp according to an aspect of the present disclosure includes: a light emitting element; and a plate-shaped light guide arranged such that a longitudinal direction thereof crosses an optical axis of the light emitting element, the plate-shaped light guide including: an introducing portion provided on a first surface thereof facing the light emitting element configured to introduce light from the light emitting element into the plate-shaped light guide; a reflecting portion provided on a second surface opposite to the first surface and configured to reflect the light introduced into the plate-shaped light guide in the introducing portion; and an emitting portion provided on a front end surface thereof and configured to emit the light reflected by the reflecting portion to a front side of the lamp. The reflecting portion is arranged in front of the optical axis, and includes a front side reflective surface that reflects the light from the introducing portion toward the emitting portion. The front side reflective surface includes a plurality of diffusing steps that diffuses the light from the introducing portion in an extending direction of the plate-shaped light guide.

A diffusing step may be a concave-shaped cylindrical step.

A cylindrical step located at a center of the front side reflective surface may have the largest radius of curvature, and a radius of curvature may become smaller as a cylindrical step is located at a lateral side.

The front side reflective surface may further include a multistage reflective surface arranged on each lateral side of the plurality of diffusing steps.

The vehicle lamp may further include an inner lens arranged so as to cover the plate-shaped light guide. The inner lens may include an extending portion that extends from a part of the inner lens, and a step formed such that light beam introduced into the part of the inner lens reaches the plate-shaped light guide.

According to the present disclosure, it is possible to provide a vehicle lamp in which the brightness uniformity of the emitted light is enhanced.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawings, which form a part hereof. The illustrative embodiments described in the detailed description, drawing, and claims are not meant to be limiting. Other embodiments may be utilized, and other changes may be made, without departing from the spirit or scope of the subject matter presented here.

Hereinafter, a vehicle lamp according to an embodiment of the present disclosure will be described in detail with reference to the drawings. In the present specification, the terms representing directions such as, for example, "upper," "lower," "front," "rear," "left," "right," "inner," and "outer" as used here mean directions in a posture when the vehicle lamp is mounted on the vehicle.

Figure 1:
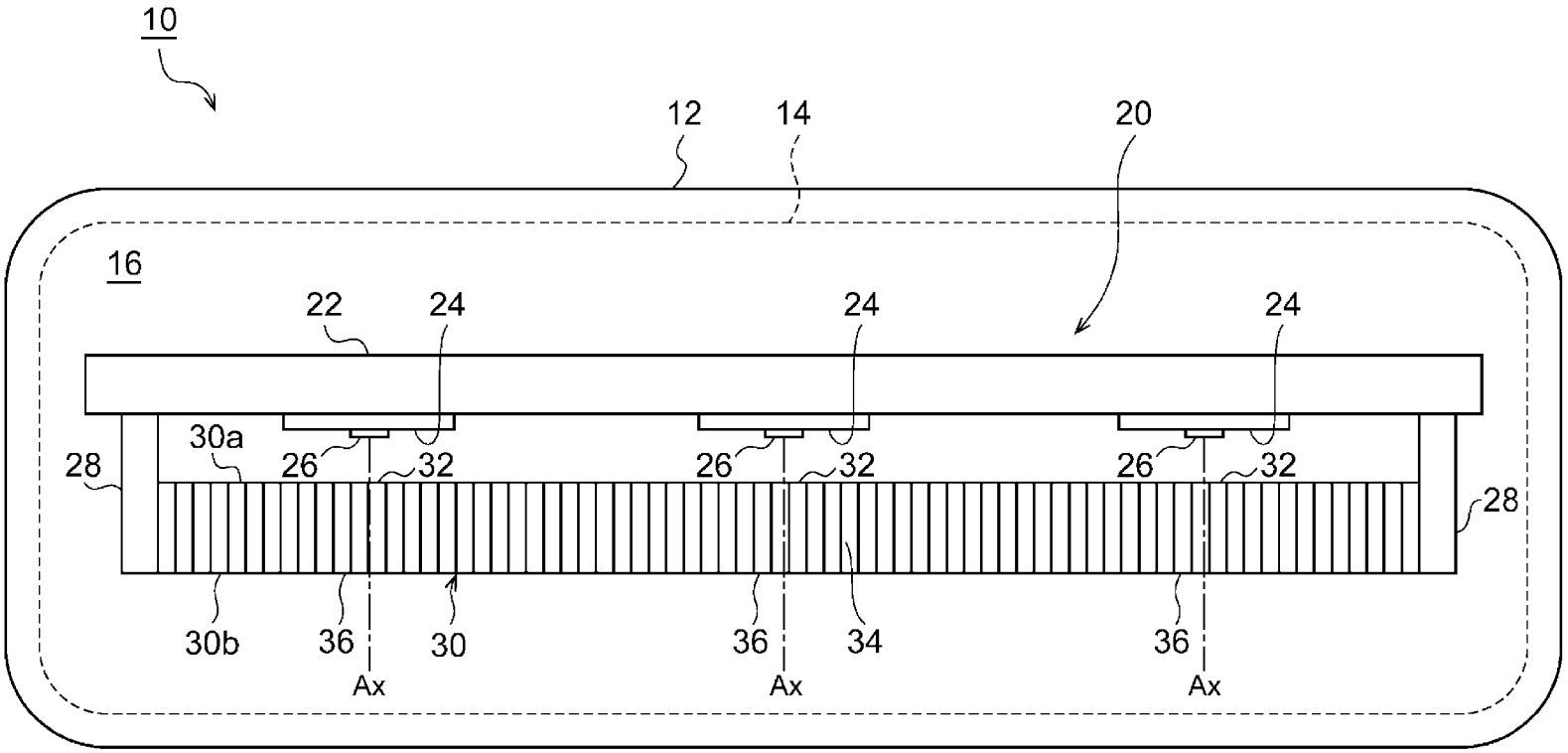
FIG. 1 is a schematic front view of a vehicle lamp according to an embodiment of the present disclosure.

FIG. 1 is a schematic front view of a vehicle lamp 10 according to an embodiment of the present disclosure. The vehicle lamp 10 may be used, for example, as a turn signal lamp, a clearance lamp, or a daytime running lamp mounted on a front portion of a vehicle. Further, the vehicle lamp 10 may also be used as a marker lamp in the rear portion of the vehicle, for example, a turn signal lamp, a tail lamp, or a stop lamp.

As illustrated in FIG. 1, the vehicle lamp 10 includes a lamp body 12, a transparent cover 14 that covers a front opening of the lamp body 12, and a lamp unit 20 provided in a lamp chamber 16 formed by the lamp body 12 and the cover 14.

As illustrated in FIG. 1, the lamp unit 20 includes a base member 22, three substrates 24 provided on the base member 22, three LEDs 26 mounted on the substrates 24 respectively, a plate-shaped light guide 30 that receives light from the LEDs 26, and a support member 28 that supports the plate-shaped light guide 30.

Figure 2:
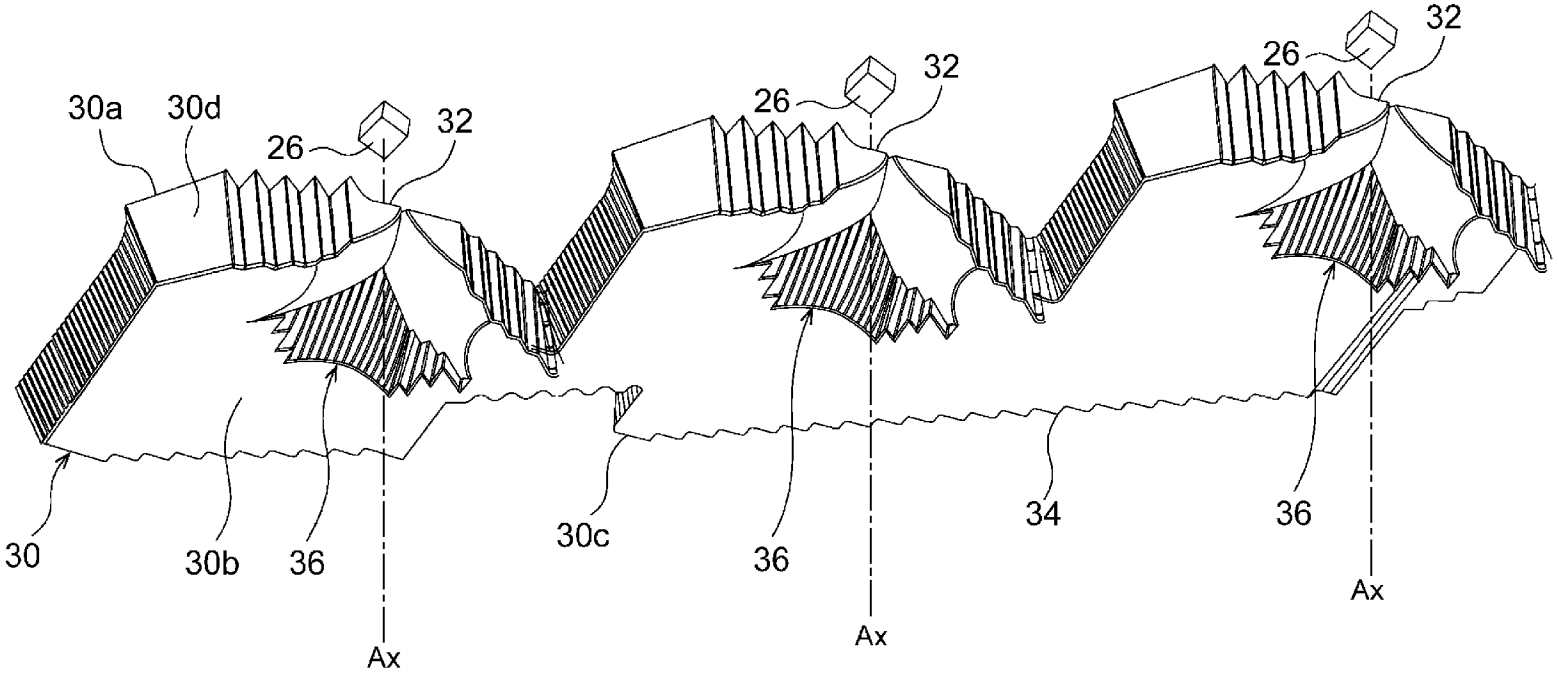
FIG. 2 is a schematic perspective view of a plate-shaped light guide as viewed from below.

FIG. 2 is a schematic perspective view of the plate-shaped light guide 30 as viewed from below. The plate-shaped light guide 30 includes an introducing portion 32, which introduces the light from each LED 26 into the plate-shaped light guide 30, on a first surface (upper surface) 30*a* facing the LEDs 26. Further, the plate-shaped light guide 30 includes a reflecting portion 36, which reflects the light introduced into the plate-shaped light guide 30 in the introducing portion 32, on a second surface (lower surface) 30*b* opposite to the first surface 30*a*. The introducing portion 32 and the reflecting portion 36 are provided for each of the LEDs 26. Further, the plate-shaped light guide 30 includes an emitting portion 34, which emits light to the front side of the lamp, on a front end surface 30*c* of the plate-shaped light guide 30. The emitting portion 34 has a shape that conforms to the shape of the entire vehicle, and is inclined (slanted) to the vehicle width direction. The three LEDs 26 conform to the shape of the emitting portion 34, and are arranged to be parallel in a direction inclined to the vehicle width direction.

Figure 3:
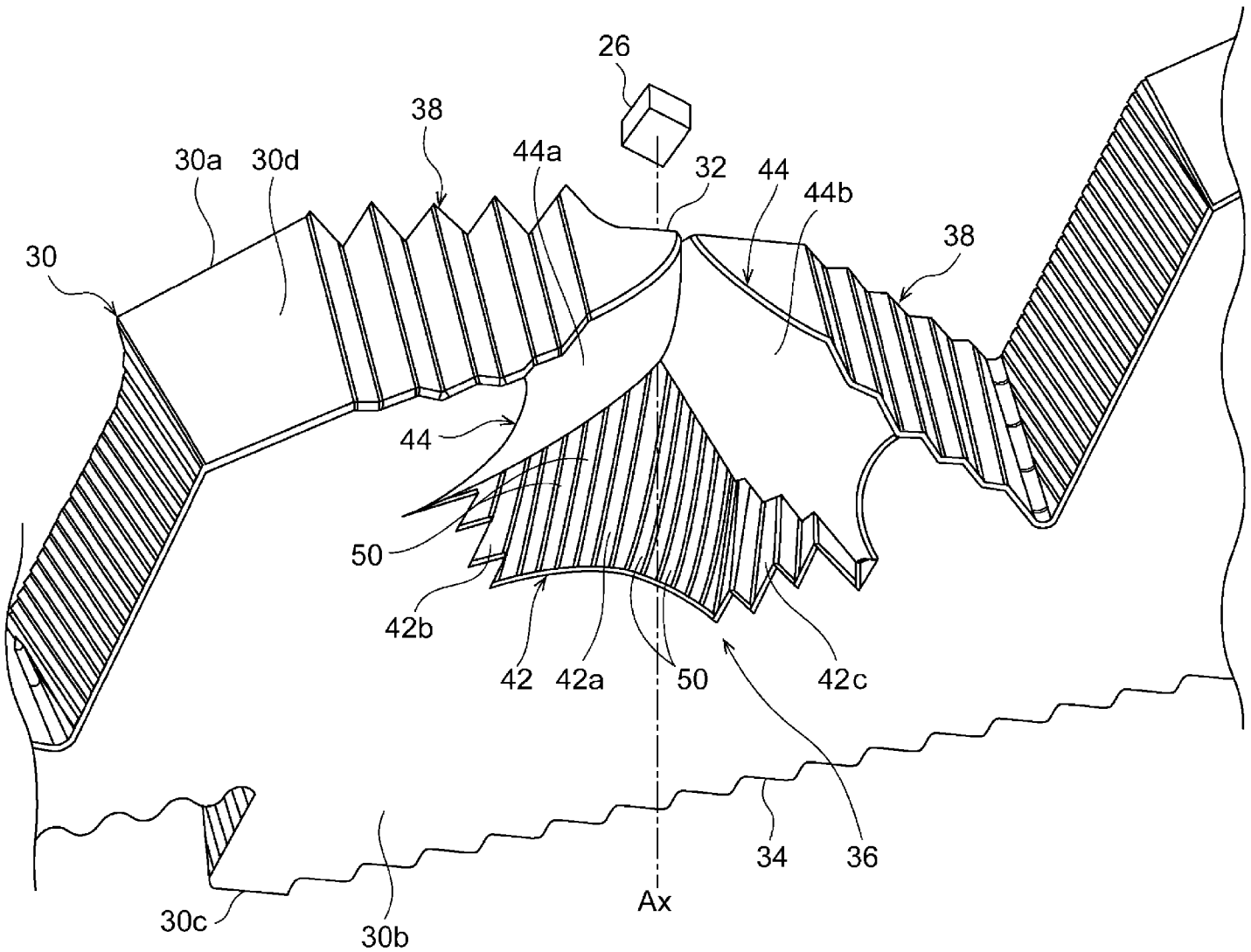
FIG. 3 is a schematic perspective view of a part of the plate-shaped light guide as viewed from below.
Figure 4:
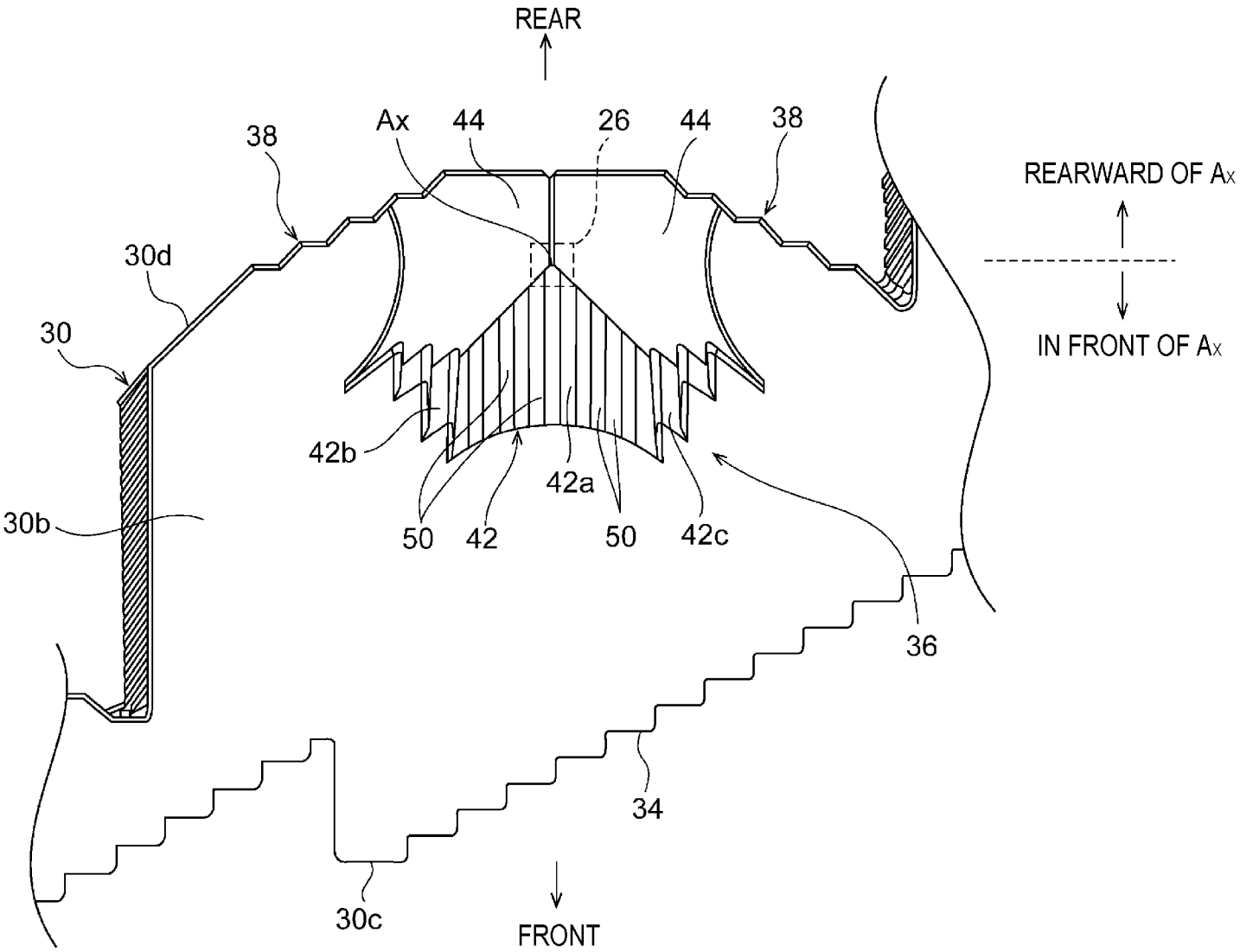
FIG. 4 is a schematic bottom view of a part of the plate-shaped light guide.

FIG. 3 is a schematic perspective view of a part of the plate-shaped light guide 30 as viewed from below. FIG. 4 is a schematic bottom view of a part of the plate-shaped light guide 30. Here, one LED 26 and a configuration of a part of the plate-shaped light guide 30 that controls light from the one LED 26 will be described with reference to FIGS. 3 and 4, but other LEDs 26 and other parts of the plate-shaped light guide 30 have the same configuration.

In the present embodiment, the plate-shaped light guide 30 is arranged such that a longitudinal direction thereof crosses (e.g., orthogonally) an optical axis AX of the LED 26. The plate-shaped light guide 30 includes the first surface (upper surface) 30*a* facing the LED 26, the second surface (lower surface) 30*b* opposite to the first surface 30*a*, the front end surface 30*c* facing the front side of the lamp, and a rear end surface 30*d* facing the rear of the lamp. The plate-shaped light guide 30 is formed of, for example, a transparent resin material such as acrylic or polycarbonate.

As described above, the introducing portion 32 is provided on the first surface 30*a* of the plate-shaped light guide 30 to introduce the light from the LED 26 into the plate-shaped light guide 30. The introducing portion 32 has a planar shape in the present embodiment.

As described above, the reflecting portion 36 is provided on the second surface 30*b* of the plate-shaped light guide 30 to reflect the light introduced into the plate-shaped light guide 30 in the introducing portion 32. The reflecting portion 36 is provided at a position facing the introducing portion 32, and is formed as a recess in which the second surface 30*b* of the plate-shaped light guide 30 is recessed inwards. The detailed configuration of the reflecting portion 36 will be described later.

A rear end reflecting portion 38 is provided on the rear end surface 30*d* of the plate-shaped light guide 30. The rear end reflecting portion 38 reflects a part of the light reflected by the reflecting portion 36 toward the emitting portion 34 provided on the front end surface 30*c*. In the present embodiment, the rear end reflecting portion 38 is formed of a multistage reflective surface in which a plurality of fine reflective surfaces are connected in a step shape. When the rear end reflecting portion 38 is formed of the multistage reflective surface, it is possible to enlarge a light emission range of the emitting portion 34. In another embodiment, the rear end reflecting portion 38 may be formed as a planar-shaped reflective surface.

The front end surface 30*c* of the plate-shaped light guide 30 is formed of the emitting portion 34 that emits the light reflected by the reflecting portion 36 and the rear end reflecting portion 38 to the front side of the lamp. A plurality of steps are provided on the emitting portion 34 along the extending direction (longitudinal direction) of the plate-shaped light guide 30.

Next, descriptions will be made on a detailed configuration of the reflecting portion 36. The reflecting portion 36 of the present embodiment is divided into a front side reflective surface 42 arranged in front of the optical axis AX of the LED 26 and a rear side reflective surface 44 in which a part thereof is arranged rearward of the optical axis AX of the LED 26.

The front side reflective surface 42 totally reflects the light introduced into the plate-shape light guide 30 at the introducing portion 32 toward the emitting portion 34. As illustrated in FIGS. 3 and 4, the front side reflective surface 42 is divided into a first front side reflective surface 42*a* located at the center, a second front side reflective surface 42*b* located on the left side of the first front side reflective surface 42*a*, and a third front side reflective surface 42*c* located on the right side of the first front side reflective surface 42*a*.

The rear side reflective surface 44 totally reflects the light introduced into the plate-shape light guide 30 in the introducing portion 32 toward the rear end emitting portion 38. The rear end reflecting portion 38 totally reflects the light from the rear side reflective surface 44 toward the emitting portion 34 through the lateral side of the second front side reflective surface 42*b* and the side of the third front side reflective surface 42*c*. The rear side reflective surface 44 is divided into a first rear side reflective surface 44*a* and a second rear side reflective surface 44*b*. The first rear side reflective surface 44*a* and the second rear side reflective surface 44*b* are arranged symmetrically with respect to a cross-section in a front-end direction of the vehicle including the optical axis Ax.

Figure 5:
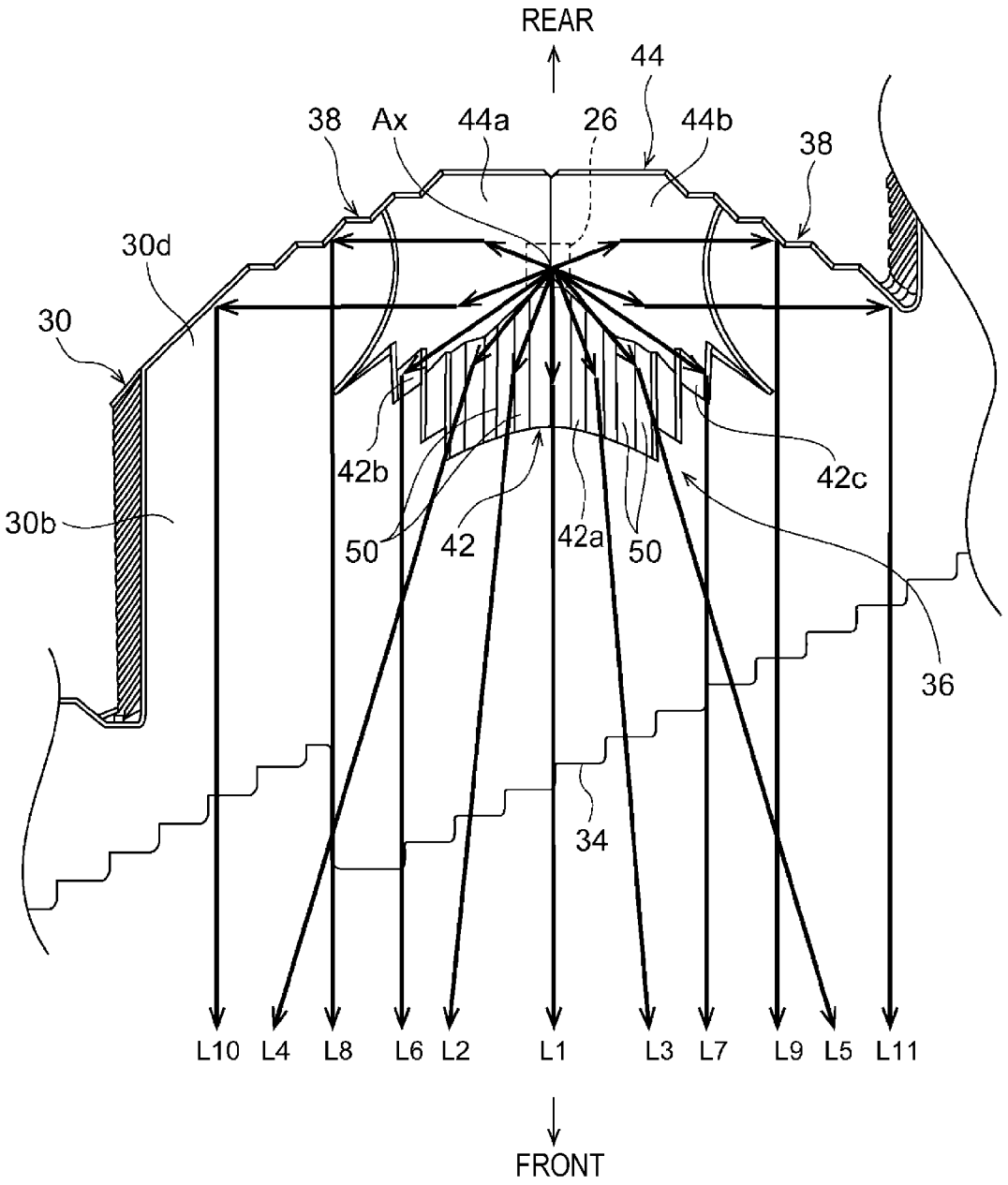
FIG. 5 is a view for explaining reflection of light by a reflecting portion of the plate-shaped light guide according to the present embodiment.

FIG. 5 is a view for explaining reflection of light by the reflecting portion 36 of the plate-shaped light guide 30 according to the present embodiment. Several exemplary light passages are illustrated in FIG. 5. Light passages of the lights L1 to L5, which are introduced into the plate-shaped light guide 30 in the introducing portion 32, and then incident on the first front side reflective surface 42*a*, are illustrated in FIG. 5. As illustrated in FIG. 5, the lights L1 to L5 incident on the first front side reflective surface 42*a* are totally reflected by the first front side reflective surface 42*a*, and then, travel in the plate-shaped light guide 30, and are emitted to the front side of the lamp from the emitting portion 34. In order to implement this, the first front side reflective surface 42*a* is formed to extend substantially in a rotational paraboloid shape toward the front side of the lamp from the optical axis Ax of the LED 26.

Further, light passages of the lights L6 and L7, which are introduced into the plate-shaped light guide 30 at the introducing portion 32, and then incident on the second front side reflective surface 42*b* and the third front side reflective surface 42*c*, are illustrated in FIG. 5. As illustrated in FIG.

5, the lights L6 and L7 incident on the second front side reflective surface 42*b* and the third front side reflective surface 42*c* are totally reflected by the second front side reflective surface 42*b* and the third front side reflective surface 42*c*, and then, travel in the plate-shaped light guide 30, and are emitted to the front side of the lamp from the emitting portion 34.

Further, light passages of the lights L8 to L11, which are introduced into the plate-shaped light guide 30 in the introducing portion 32, and then incident on the first rear side reflective surface 44*a* and the second rear side reflective surface 44*b*, are illustrated in FIG. 5. As illustrated in FIG. 5, the lights L8 to L11 incident on the first rear side reflective surface 44*a* and the second rear side reflective surface 44*b* are totally reflected by the first rear side reflective surface 44*a* and the second rear side reflective surface 44*b* toward the rear end reflecting portion 38. In order to implement this, the first rear side reflective surface 44*a* and the second rear side reflective surface 44*b* are formed to extend substantially in a rotational paraboloid shape toward the lateral side of the lamp from the optical axis Ax of the LED 26. Thereafter, the lights L8 to L11 are totally reflected again by the rear end reflecting portion 38, travel in the plate-shaped light guide 30 through the lateral side of the second front side reflective surface 42*b* and the side of the third front side reflective surface 42*c*, and are emitted to the front side of the lamp from the emitting portion 34.

In the plate-shaped light guide 30 of the embodiment, a plurality of concave-shaped cylindrical steps 50 are formed in parallel in the left-right direction on the first front side reflective surface 42*a*. A cylindrical step 50 functions as a diffusing step that diffuses the light from the introducing portion 32 in the extending direction of the plate-shaped light guide 30.

Figure 6:
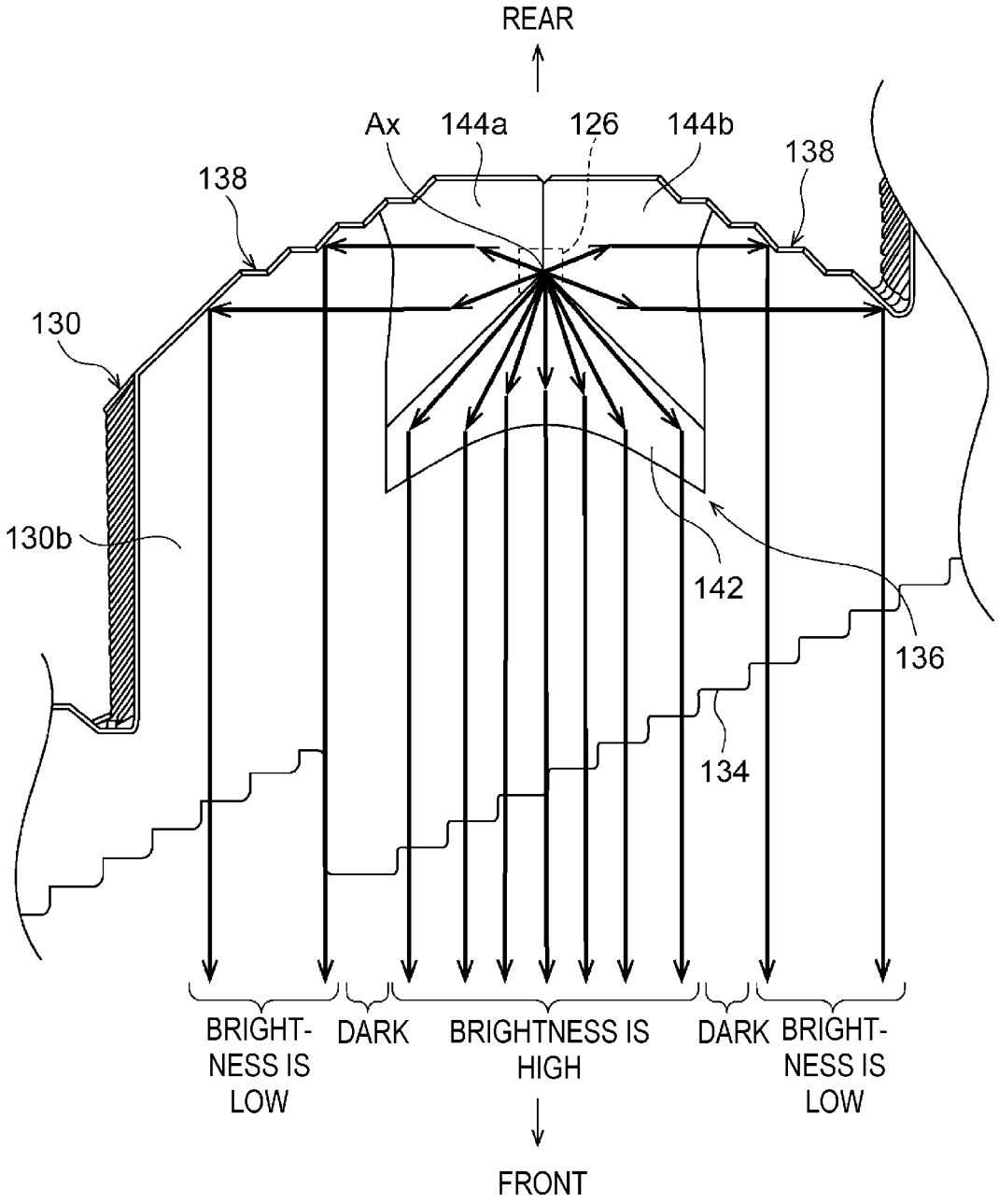
FIG. 6 is a view illustrating a plate-shaped light guide according to a comparative example.

Here, in order to explain the effect of the cylindrical step 50 formed on the first front side reflective surface 42*a*, a case where the diffusing step is not formed on the first front side reflective surface will be described as a comparative example. FIG. 6 illustrates a plate-shaped light guide 130 according to the comparative example. The plate-shaped light guide 130 also includes a reflecting portion 136 that reflects light from an LED 126 that is introduced into the plate-shaped light guide 130. In the plate-shaped light guide 130, the reflecting portion 136 is divided into a front side reflective surface 142, a first rear side reflective surface 144*a*, and a second rear side reflective surface 144*b*.

The front side reflective surface 142 of the plate-shaped light guide 130 according to the comparative example is formed to extend substantially in a rotational paraboloid shape toward the front side of the lamp from the optical axis Ax of the LED 126, similarly to the first front side reflective surface 42*a* of the plate-shaped light guide 30 according to the present embodiment. However, as illustrated in FIG. 6, the diffusing step is not formed on the front side reflective surface 142 of the comparative example, the front side reflective surface 142 is a smooth curved surface. As illustrated in FIG. 6, the light incident on the front side reflective surface 142*a* is totally reflected as substantially parallel light toward the front side of the lamp, and then is emitted from an emitting portion 134.

In the plate-shaped light guide 130 according to the comparative example, the configurations of the first rear side reflective surface 144*a*, the second rear side reflective surface 144*b*, and a rear end reflecting portion 138 are the same as the plate-shaped light guide 30 according to the present embodiment. That is, the light toward the first rear side reflective surface 144*a* and the second rear side reflective surface 144*b* is totally reflected by the first rear side reflective surface 144*a* and the second rear side reflective surface 144*b* toward the rear end reflecting portion 138. The light introduced into the rear end reflecting portion 138 is totally reflected by the rear end reflecting portion 138, and is emitted to the front side of the lamp from the emitting portion 134 through the lateral side of the front side reflective surface 142.

The light from the LED 126 is intensively reflected in a relatively narrow range by the front side reflective surface 142. Further, the number of times of total reflection of the light incident on the front side reflective surface 142 before being emitted from the emitting portion 134 is only one by the front side reflective surface 142. Therefore, the brightness of the light that is totally reflected by the front side reflective surface 142 and then emitted from the emitting portion 134 is high.

Meanwhile, the light from the LED 126 is reflected in a relatively wide range by the first rear side reflective surface 144*a* and the second rear side reflective surface 144*b*. Further, the number of times of total reflection of the light incident on the first rear side reflective surface 144*a* and the second rear side reflective surface 144*b* before being emitted from the emitting portion 134 is two times by the first rear side reflective surface 144*a* and the second rear side reflective surface 144*b*, and the rear end reflecting portion 138. In general, the intensity of light becomes lower as the number of times of the total reflection increases. Therefore, the brightness of the light that is totally reflected by the first rear side reflective surface 144*a* and the second rear side reflective surface 144*b*, and the rear end reflecting portion 138, and then emitted from the emitting portion 134 becomes lower as compared to the light that is totally reflected by the front side reflective surface 142 and then emitted.

Further, in the plate-shaped light guide 130 according to the comparative example, the brightness of the light that is totally reflected by the first rear side reflective surface 144*a* and the second rear side reflective surface 144*b*, and then emitted from the emitting portion 134 becomes lower as compared to the light that is totally reflected by the front side reflective surface 142 and then emitted. The light that is totally reflected by the front side reflective surface 142 and then emitted, and the light that is totally reflected by the first rear side reflective surface 144*a* and the second rear side reflective surface 144*b*, and the rear end reflecting portion 138 and then emitted are substantially parallel light as illustrated in FIG. 6. Therefore, as illustrated in FIG. 6, a dark range in which light is hardly emitted may be generated between the emission range in which the brightness is high and the emission range in which the brightness is low.

As described above, in the vehicle lamp using the plate-shaped light guide 130 according to the comparative example, it is difficult to make the brightness of the light emitted from the emitting portion 134 uniform.

The present inventors diligently studied to solve the problems of the plate-shaped light guide 130 according to the comparative example as described above. As a result, it was found that the brightness uniformity of the light emitted from the emitting portion 34 may be enhanced by forming the cylindrical steps 50 on the first front side reflective surface 42*a*. As illustrated in FIG. 5, by the cylindrical steps 50 formed on the first front side reflective surface 42*a*, a portion of the light incident on the first front side reflective surface 42*a* is diffused in the extending direction (left-right direction) of the plate-shaped light guide 30 (see lights L2 to L5). As a result, the bright light that has a single total number of reflections is diffused into the range in which the brightness of the emitted light becomes low and the dark range in which the light is hardly emitted, and thus, it is possible to enhance the brightness uniformity of the light emitted from the emitting portion 34.

As illustrated in FIGS. 3 to 5, although the plurality of cylindrical steps 50 are arranged in parallel in the left-right direction, the plurality of cylindrical steps 50 may be formed such that the cylindrical step 50 located at the center of the first front side reflective surface 42*a* has the largest radius of curvature, and a radius of curvature becomes smaller as the cylindrical step 50 is located at a lateral side. In the case where the cylindrical steps 50 are formed in this manner, the extent of diffusion of the light that is totally reflected becomes larger for the cylindrical step 50 located at the lateral side. The exemplary lights L1 to L5 illustrated in FIG. 5 are displayed such that the extent of diffusion increases for the light incident on the cylindrical step 50 located at the side. By adopting this configuration, the bright light that has a single total number of reflections may be diffused into a wider range. Therefore, it is possible to more properly enhance the brightness uniformity of the light emitted from the emitting portion 34.

In the above, the first front side reflective surface 42*a* of the first side reflective surface 42 has been described. Next, the second front side reflective surface 42*b* and the third front side reflective surface 42*c* formed on the left side and the right side of the first front side reflective surface 42*a* will be described.

In the present embodiment, most of the reflected light by the first front side reflective surface 42*a* is emitted from a range around the center in the vertical direction of the emitting portion 34. Therefore, the brightness of the upper range and the lower range of the emitting portion 34 tend to be lower. Therefore, in the present embodiment, the second front side reflective surface 42*b* and the third front side reflective surface 42*c* provided with a multistage reflective surface are provided on the left side and the right side of the first front side reflective surface 42*a*. In the present embodiment, the multistage reflective surface formed on the second front side reflective surface 42*a* and the third front side reflective surface 42*c* is configured to direct the reflected light toward the lower range of the emitting portion 34. As a result, the lowering of the brightness in the lower range of the emitting portion 34 may be suppressed, and thus, it is possible to further enhance the brightness uniformity of the light emitted from the emitting portion 34. In another embodiment, a multistage reflective surface configured to direct the reflected light toward the upper range of the emitting portion 34 may be provided.

Figure 7:
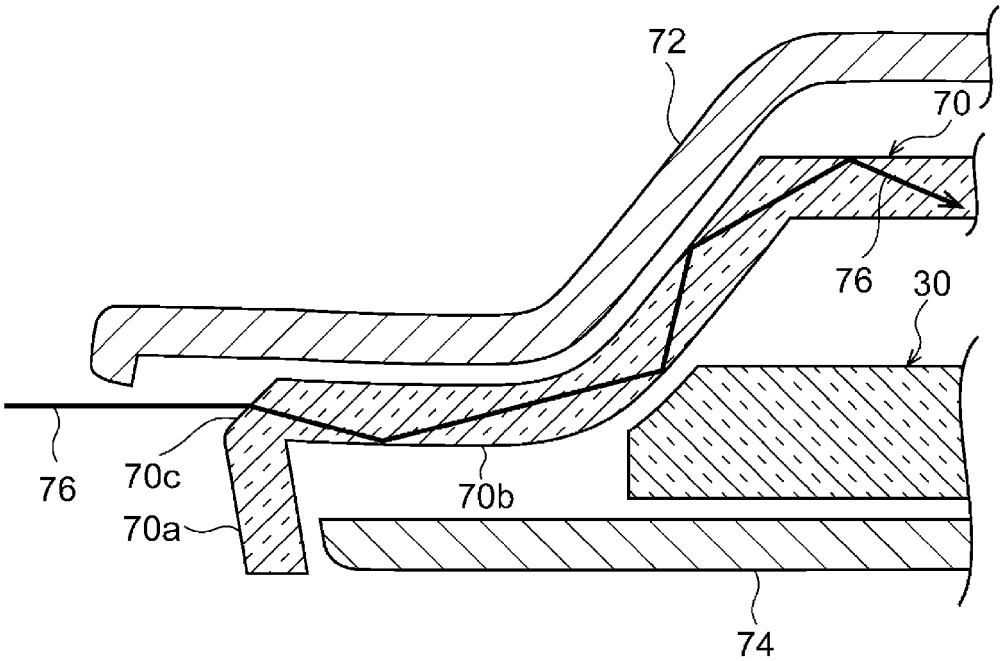
FIG. 7 is a schematic cross-sectional view illustrating a part of a vehicle lamp.

FIG. 7 is a schematic cross-sectional view illustrating a part of the vehicle lamp. As illustrated in FIG. 7, the above-described plate-shaped light guide 30 is covered with an inner lens 70, and the light emitted from the emitting portion 34 of the front end surface of the plate-shaped light guide 30 is irradiated to the front side of the lamp via the inner lens 70. As illustrated in FIG. 7, light shielding components 72 and 74 are provided above and below the plate-shaped light guide 30 and the inner lens 70.

Figure 8:
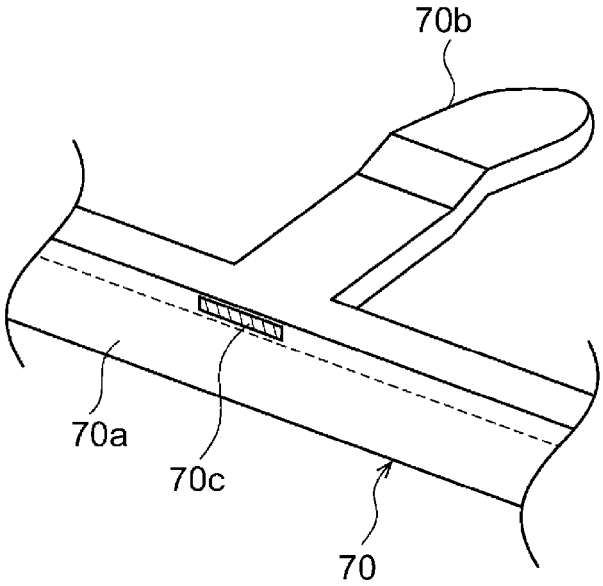
FIG. 8 is a schematic perspective view illustrating a part of an inner lens.

FIG. 8 is a schematic perspective view illustrating a part of the inner lens 70. As illustrated in FIG. 8, the inner lens 70 includes a lens body 70*a* and an attaching portion 70*b* configured to attach the lens body 70*a* to the lamp body 12 (see FIG. 1). The attaching portion 70*b* extends rearward from a part of a back surface of the lens body 70*a*.

When the inner lens 70 is viewed from the front side of the lamp in a state where the inner lens 70 is attached to the vehicle lamp as illustrated in FIG. 7, a portion from which the attaching portion 70*b* extends may appear different from other portions, as illustrated in FIG. 8. For example, the portion 70*c* from which the attaching portion 70*b* extends may appear darker than other portions.

The reason will be described with reference to FIG. 7. In FIG. 7, a light beam 76 introduced into the inner lens 70 from the front side of the lamp. According to the light beam reverse principle, a portion where the light beam 76 reaches becomes a portion seen as the portion 70*c* from which the attaching portion 70*b* extends, when the inner lens 70 is viewed from the front side of the lamp. In the example illustrated in FIG. 7, the light beam 76 is guided in the attaching portion 70*b* and reaches the tip of the attaching portion 70*b*. That is, when the inner lens 70 is viewed from the front side of the lamp, the dark portion of the tip of the attaching portion 70*b* is appeared at the portion 70*c* from which the attaching portion 70*b* extends. As described above, when the portion 70*c* from which the attaching portion 70*b* extends appears different from other portions, the appearance of the vehicle lamp may be degraded.

Figure 9:
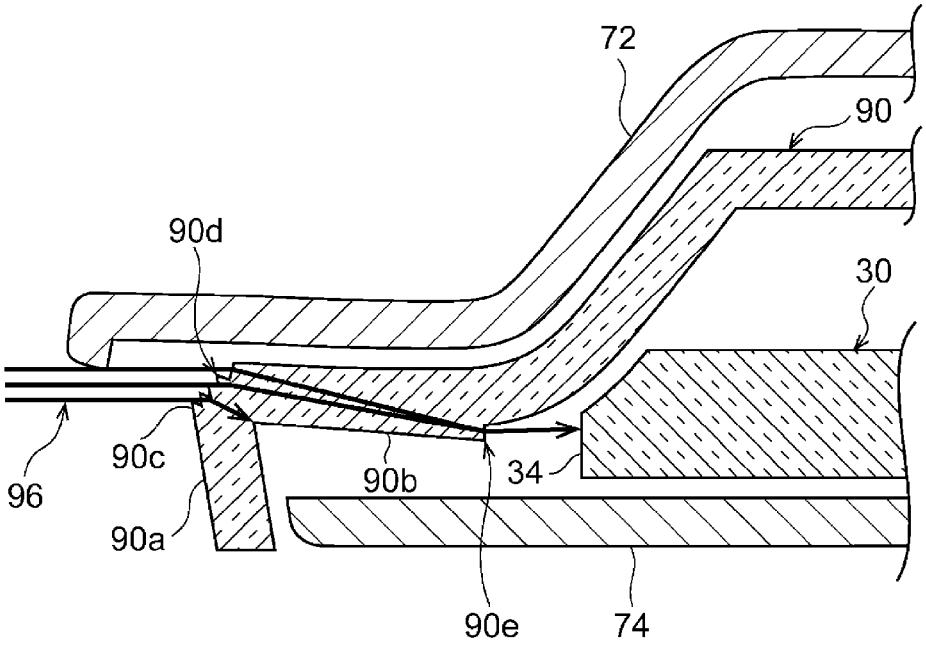
FIG. 9 is a schematic cross-sectional view for explaining an improved inner lens.

FIG. 9 is a schematic cross-sectional view for explaining an improved inner lens 90. As illustrated in FIG. 9, the inner lens 90 includes steps 90*d* on a surface of a lens body 90*a*. Further, a stage 90*e* is formed in the middle of an attaching portion 90*b* that extends rearward from the lens body 90*a*. By providing the steps 90*d* and the stage 90*e* on the inner lens 90, a light beam 96 introduced into the inner lens 90 is refracted by the steps 90*d*, and then, is emitted from the stage 90*e* provided in the middle of the attaching portion 90*b*, and reaches the plate-shaped light guide 30. That is, according to the light beam reverse principle, when the inner lens 90 is viewed from the front side of the lamp, the plate-shaped light guide 30 is appeared at a portion 90*c* from which the attaching portion 90*b* extends. As described above, by making the relatively bright plate-shaped light guide 30 visible from the portion 90*c* from which the attaching portion 90*b* extends, the difference in visibility with other portions of the lens body 90*a* is reduced, and thus, it is possible to prevent the appearance of the vehicle lamp being degraded.

In the embodiment described above, an LED is illustrated as a light emitting element. However, a light emitting element is not limited to an LED, for example, a laser diode (LD) may be used.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A vehicle lamp comprising:

a light emitting element; and a plate-shaped light guide arranged such that a longitudinal direction thereof crosses an optical axis of the light emitting element, the plate-shaped light guide including: an introducing portion provided on a first surface thereof facing the light emitting element and configured to introduce light from the light emitting element into the plate-shaped light guide; a reflecting portion provided on a second surface thereof opposite to the first surface and configured to reflect the light introduced into the plate-shaped light guide in the introducing portion; and an emitting portion provided on a front end surface thereof and configured to emit the light reflected by the reflecting portion to a front side of the lamp, wherein the reflecting portion is arranged in front of the optical axis, and includes a front side reflective surface that reflects the light from the introducing portion toward the emitting portion, and the front side reflective surface includes a plurality of diffusing steps that diffuses the light from the introducing portion in an extending direction of the plate-shaped light guide, wherein at least some of the diffusing steps are concave-shaped cylindrical steps, and a cylindrical step located at a center of the front side reflective surface has the largest radius of curvature.

2. The vehicle lamp according to claim 1, wherein a radius of curvature of each of the some of the diffusing steps becomes smaller as the corresponding cylindrical step is located at a lateral side.

3. The vehicle lamp according to claim 1, wherein the front side reflective surface further includes a multistage reflective surface arranged on each lateral side of the plurality of diffusing steps.

4. The vehicle lamp according to claim 1, further comprising:

an inner lens arranged so as to cover the plate-shaped light guide, wherein the inner lens includes an extending portion that extends from a part of the inner lens, and a step formed such that a light beam introduced into the part of the inner lens reaches the plate-shaped light guide.

5. A vehicle lamp comprising:

a light emitting element; and a plate-shaped light guide arranged such that a longitudinal direction thereof crosses an optical axis of the light emitting element, the plate-shaped light guide including: an introducing portion provided on a first surface thereof facing the light emitting element and configured to introduce light from the light emitting element into the plate-shaped light guide; a reflecting portion provided on a second surface thereof opposite to the first surface and configured to reflect the light introduced into the plate-shaped light guide in the introducing portion; and an emitting portion provided on a front end surface thereof and configured to emit the light reflected by the reflecting portion to a front side of the lamp, wherein the reflecting portion is arranged in front of the optical axis, and includes a front side reflective surface that reflects the light from the introducing portion toward the emitting portion, and the front side reflective surface includes a plurality of diffusing steps that diffuses the light from the introducing portion in an extending direction of the plate-shaped light guide, wherein the vehicle lamp further comprises: further comprising:

an inner lens arranged so as to cover the plate-shaped light guide, wherein the inner lens includes an extending portion that extends from a part of the inner lens, and a step formed such that a light beam introduced into the part of the inner lens reaches the plate-shaped light guide.

6. The vehicle lamp according to claim 5, wherein at least some of the diffusing steps are concave shaped cylindrical steps.

7. The vehicle lamp according to claim 6, wherein a cylindrical step located at a center of the front side reflective surface has the largest radius of curvature.

8. The vehicle lamp according to claim 7, wherein a radius of curvature of each of the some of the diffusing steps becomes smaller as the corresponding cylindrical step is located at a lateral side.

9. The vehicle lamp according to claim 5, wherein the front side reflective surface further includes a multistage reflective surface arranged on each lateral side of the plurality of diffusing steps.

* * * * *